United States Patent [19]

Herberling

[11] Patent Number: 4,533,314

[45] Date of Patent: Aug. 6, 1985

[54] METHOD FOR REDUCING NITRIC OXIDE EMISSIONS FROM A GASEOUS FUEL COMBUSTOR

[75] Inventor: Paul V. Herberling, Scotia, N.Y.

[73] Assignee: General Electric Company, Schenectady, N.Y.

[21] Appl. No.: 548,374

[22] Filed: Nov. 3, 1983

[51] Int. Cl.[3] ..... F23J 7/00

[52] U.S. Cl. ..... 431/4; 431/160; 431/176; 431/187; 60/39.55

[58] Field of Search ..... 431/4, 160, 176, 181, 431/187, 190, 284; 60/39.52, 39.55; 239/13, 132.5, 422, 424

[56] References Cited

U.S. PATENT DOCUMENTS

| | | | |
|---|---|---|---|
| 3,229,746 | 1/1966 | Wagner et al. | 431/190 |
| 3,826,080 | 7/1974 | De Corso et al. | 60/39.55 |
| 4,110,973 | 9/1978 | Haeflich et al. | 431/4 X |
| 4,337,618 | 7/1982 | Hughes et al. | 60/39.55 |
| 4,394,118 | 7/1983 | Martin | 431/4 |
| 4,406,610 | 9/1983 | Duijvestijn | 431/4 |
| 4,445,842 | 5/1984 | Syska | 431/187 X |

FOREIGN PATENT DOCUMENTS

| | | | |
|---|---|---|---|
| 0151020 | 9/1981 | Fed. Rep. of Germany | 431/160 |
| 0014226 | 2/1977 | Japan | 431/4 |
| 0159179 | 1/1979 | Netherlands | 431/187 |
| 172755 | 12/1921 | United Kingdom | 431/187 |
| 0007697 | 2/1980 | United Kingdom . | |

*Primary Examiner*—Margaret A. Focarino

*Attorney, Agent, or Firm*—Lawrence D. Cutter; James C. Davis, Jr.; Marvin Snyder

[57] ABSTRACT

A method for reducing nitric oxide emissions from a gaseous fuel combustor includes introducing a combustion gas containing nitrogen and oxygen, such as air, into a combustion chamber and introducing a fuel gas into the same chamber. A cooling gas, such as steam, is interleaved between the combustion gas and the fuel gas substantially at the point where they are introduced into the chamber. The concentration of cooling gas in the flame front is maximized by this method, resulting in a lower temperature for the flame front and, correspondingly, lower production of nitric oxide emissions. Apparatus for carrying out the invention includes a combustion chamber, a body having a channel through which combustion gas can be introduced into the combustion chamber, a fuel gas nozzle for introducing fuel gas into the combustion chamber, and an orifice around the nozzle for interleaving cooling gas between the fuel gas and the combustion gas.

7 Claims, 3 Drawing Figures

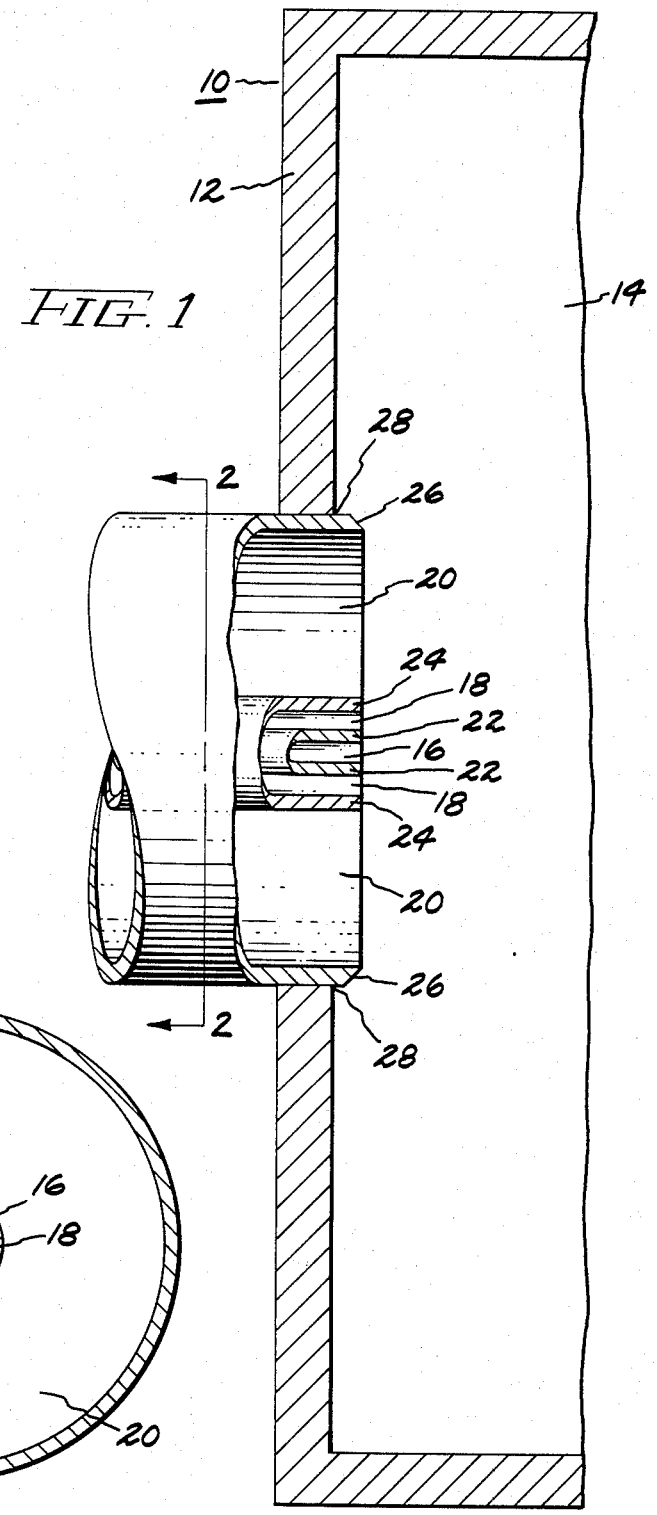
FIG. 1
FIG. 2
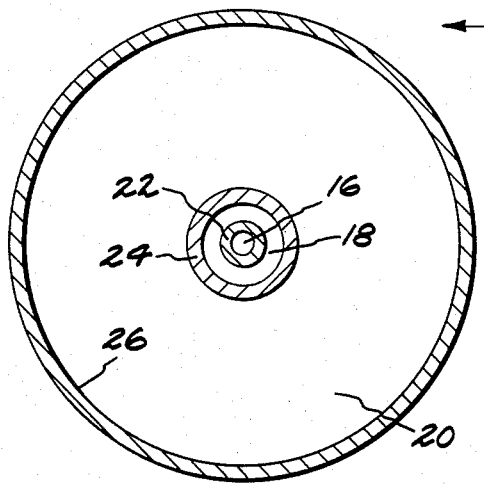

METHOD FOR REDUCING NITRIC OXIDE EMISSIONS FROM A GASEOUS FUEL COMBUSTOR

BACKGROUND OF THE INVENTION

This invention relates to reducing nitric oxide emissions from a gaseous fuel combustor. More particularly, it relates to interleaving a cooling gas between the fuel and the air used for such a combustor, at the point where the fuel and the air enter the combustion chamber.

It is well known that water vapor has a significant effect on nitric oxide production in flames burning in air. Thermal nitric oxide production has been found to be strongly dependent on the temperature of the flame and on the oxygen concentration, in a somewhat complex relationship. Water vapor reduces the flame temperature, and the water in the flame also reduces the oxygen concentration. The combination of these effects results in a large reduction in the rate of nitric oxide production.

Applying these principles to gas turbine combustors, previous investigators have injected steam into the combustor in order to reduce thermal nitric oxide emissions from the combustor. Typically, steam has been injected upstream of the main air swirler for the combustor, with the result that steam is partially pre-mixed with the combustion air. However, it has been found that injection of steam in this manner is less effective than expected. It has been observed that injection of steam by prior art methods is not as effective as injection of water, even after accounting for the water's latent heat of vaporization. To achieve the level of control of nitric oxide emissions predicted from the above principles, it has been found that it is necessary to inject more steam than expected. This additional steam may lower the system's thermal efficiency, increase consumption of demineralized water, and cause high dynamic pressures and shortened combustor life.

The present inventor has concluded that the primary reason why water injection is more effective than steam injection in reducing nitric oxide emissions, even after accounting for the water's latent heat of vaporization, is that the water droplets tend to evaporate in the flame front, where the temperature is highest. Hence, the cooling effect of the water's latent and sensible heat is greatest in the flame front and automatically occurs where it is most effective in reducing the thermal nitric oxide production rate. The present inventor has also concluded that for steam injection to be as effective as water injection, the steam should be injected in such a manner that the steam concentration within the flame front is maximized.

Accordingly, it is an object of the present invention to provide a method for reducing nitric oxide emissions from a gaseous fuel combustor.

It is a further object of the present invention to provide a method for using a cooling gas in a gaseous fuel combustor in order to reduce nitric oxide emissions therefrom.

It is also an object of the present invention to provide a method for introducing a cooling gas to a gaseous fuel combustor in such a manner that the concentration of cooling gas within the flame front is maximized.

It is still another object of the present invention to provide apparatus for reducing nitric oxide emissions that is readily adaptable to existing gaseous fuel combustors.

SUMMARY OF THE INVENTION

In accordance with one embodiment of the present invention, a method for reducing nitric oxide emissions from a gaseous fuel combustor comprises introducing a combustion gas containing nitrogen and oxygen into a combustion chamber and introducing a fuel gas into the same chamber. A cooling gas is introduced into the chamber in such a manner that the cooling gas is interleaved between the combustion gas and the fuel gas substantially at the point where the two gases are introduced into the chamber. Preferably, the cooling gas is introduced in a manner such that the amount of the cooling gas that mixes with the combustion gas is approximately equal to the amount of the cooling gas that mixes with the fuel gas.

In accordance with another embodiment of the present invention, a preferred apparatus for carrying out the present invention comprises a combustion chamber defined by a combustion chamber wall and a body having a channel defined therethrough for introducing the combustion gas into the combustion chamber, with one end of the channel being in flow communication with the combustion chamber by means of an aperture through the combustion chamber wall. The apparatus also includes a fuel gas nozzle for introducing fuel gas into the combustion chamber, with the nozzle being in flow communication with the combustion chamber by means of the same aperture through the combustion chamber wall. The apparatus further comprises a body at least partially surrounding the fuel gas nozzle and disposed so that an orifice is defined between the outer surface of the fuel gas nozzle and the inner surface of the body, in order that cooling gas flowing through the orifice is interleaved between fuel gas flowing through the nozzle and combustion gas flowing through the channel substantially at the point where the two gases are introduced into the combustion chamber.

BRIEF DESCRIPTION OF THE DRAWINGS

The subject matter which is regarded as the invention is particularly pointed out and distinctly claimed in the concluding portion of the specification. The invention itself, however, both as to its organization and its method of practice, together with further objects and advantages thereof, may best be understood by reference to the following description taken in conjunction with the accompanying drawings, in which:

FIG. 1 is a partial cross-sectional, side elevation view schematically illustrating one embodiment of the present invention;

FIG. 2 is a cross-sectional view of the apparatus shown in FIG. 1, taken along line 2—2.

DETAILED DESCRIPTION OF THE INVENTION

Figure 3:
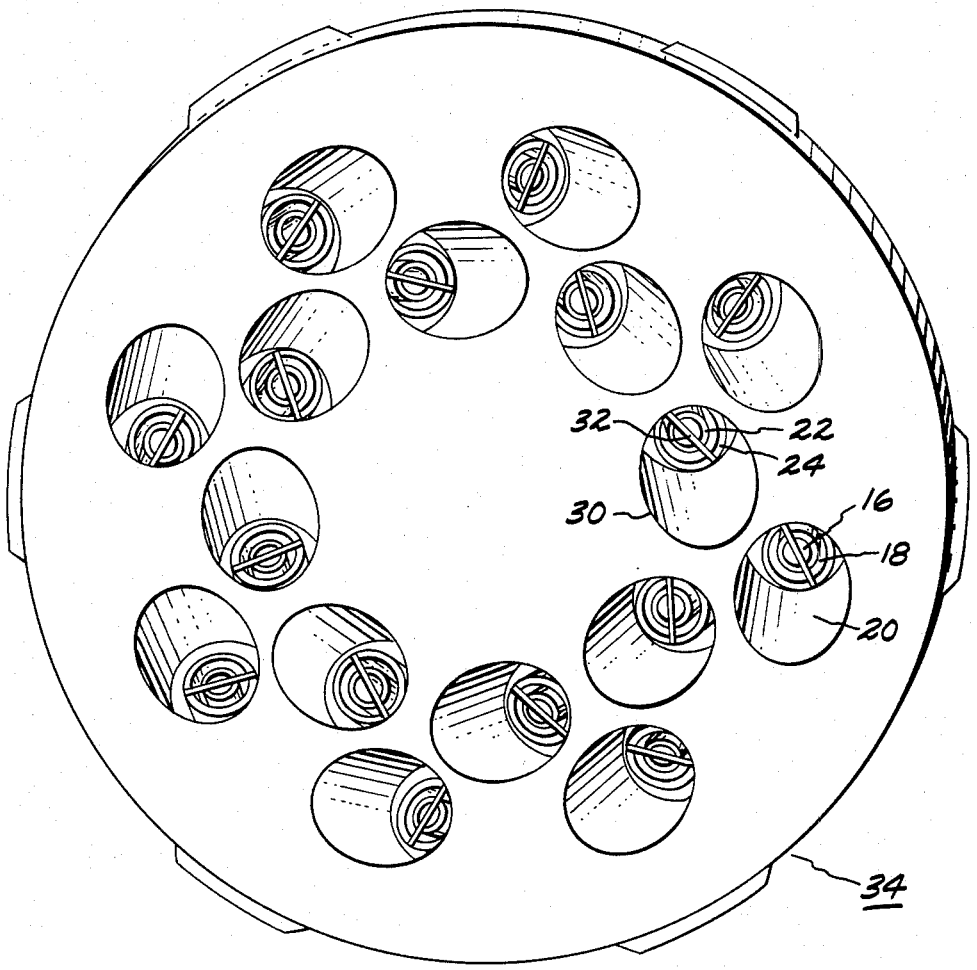
FIG. 3 is a perspective view schematically illustrating an embodiment of the present invention which is readily adaptable to existing gaseous fuel combustors.

The instant applicant has found that, to minimize nitric oxide emissions from a gaseous fuel combustor by introducing a cooling gas therein, the concentration of the cooling gas at the flame front should be maximized. In accordance with the present invention, a method for doing so comprises introducing a combustion gas containing nitrogen and oxygen into a combustion chamber and introducing a fuel gas into the same chamber. A cooling gas is interleaved between the combustion gas and the fuel gas substantially at the point where the gases are introduced into the chamber. Preferably, cooling gas is introduced into the chamber in such a manner that the amount of cooling gas that mixes with the combustion gas is approximately equal to the amount of cooling gas that mixes with the fuel gas. As a result of this interleaving process, the concentration of the cooling gas is maximized at the flame front. The flame front preferentially occurs where the gases are in roughly stoichiometric proportions. For such a flame front, the concentration of cooling gas at the flame front is sufficient to lower the temperature of the flame front to below the temperature at which the production rate of thermal nitric oxide becomes significant, but above the temperature required for combustion rates useful in gaseous fuel combustors. This lowered temperature, along with a reduction in the oxygen concentration in the flame front, results in a large reduction in nitric oxide emissions from a gaseous fuel combustor.

Amont other applications, the present invention is useful for gas turbine combustors fired with a gaseous fuel. In typical such combustors, the combustion gas comprises air and the cooling gas comprises steam. The fuel gas often comprises methane. The present invention is also useful for boiler furnaces fired with a gaseous fuel. In typical boilers, the combustion gas comprises air and the fuel gas often comprises methane. In this application of the present invention, the cooling gas may comprise recirculated exhaust gas.

FIG. 1 schematically illustrates one embodiment of an apparatus suitable for practicing the instant invention. In the embodiment shown, gaseous fuel combustor 10 includes combustion chamber 14 defined by combustion chamber wall 12. A means for introducing a combustion gas containing nitrogen and oxygen into combustion chamber 14 comprises body 26 having a substantially cylindrical channel extending therethrough. Body 26 is disposed in aperture 28 in combustion chamber wall 12. Substantially cylindrically shaped body 24 is located inside body 26 and disposed substantially coaxially with the longitudinal axis of the channel in body 26, so that annularly shaped orifice 20 is defined by the outer surface of body 24 and the inner surface of body 26. Orifice 20 is in flow communication with combustion chamber 14, in order that combustion gas may be introduced into combustion chamber 14 through orifice 20. Means for introducing a fuel gas into combustion chamber 14 comprises substantially cylindrically shaped fuel gas nozzle 22, located in the interior of cylindrically shaped body 24 and disposed substantially coaxially with the central axis of body 24. Nozzle 22 includes opening 16 in flow communication with combustion chamber 14, through which fuel gas may be introduced into combustion chamber 14. Nozzle 22 is further disposed so that annularly shaped orifice 18 in flow communication with combustion chamber 14 is defined by the outer surface of nozzle 22 and by the inner surface of body 24, so that a cooling gas may be introduced into combustion chamber 14 through orifice 18. Nozzle 22, cylindrical body 24, and body 26 are further disposed so that cooling gas flowing through orifice 18 is interleaved between fuel gas flowing through opening 16 of nozzle 22 and combustion gas flowing through orifice 20, substantially at the point where the gases are introduced into combustion chamber 14. Preferably, nozzle 22, cylindrical body 24, and body 26 are further disposed so that the cooling gas mixes with the combustion gas and the fuel gas at approximately equal rates.

In the embodiment shown in FIG. 1, nozzle 22, cylindrical body 24, and body 26 all protrude into combustion chamber 14. However, for any particular application, whether nozzle 22, cylindrical body 24, and body 26 protrude into combustion chamber 14, how much they protrude, and whether they protrude by equal amounts all are determined by the particular application involved. For applications where it is desirable, nozzle 22 and cylindrical body 24 may be axially retracted into the interior of body 26, away from combustion chamber 14. For such an embodiment, the cooling gas is still interleaved between the fuel gas and the combustion gas, but the flow characteristics of the gases may be improved.

FIG. 2 is a cross-sectional view of the apparatus of FIG. 1 taken along line 2—2, further illustrating the means for introducing fuel gas, cooling gas, and combustion gas into combustion chamber 14. Fuel gas is introduced into combustion chamber 14 through circular opening 16 in nozzle 22. Cooling gas is introduced through annularly shaped orifice 18 defined by the inner surface of body 24 and the outer surface of nozzle 22. Combustion as is introduced into chamber 14 through annularly shaped orifice 20 defined by the inner surface of body 26 and the outer surface of body 24. In the embodiment shown in FIG. 2, opening 16 is circular in shape and orifices 18 and 20 are annular in shape. However, other shapes, such as, for example, adjacent rectangular slits, may also be used for the means employed to introduce the gases into the combustion chamber, as long as the shapes chosen result in the cooling gas being substantially interleaved between the fuel gas and the combustion gas. Furthermore, although body 24 is shown in FIG. 2 as completely surrounding nozzle 22, embodiments in which body 24 only partially surrounds nozzle 22 (that result in the cooling gas being interleaved between the fuel gas and the combustion gas) may also be used. Also, as shown in FIGS. 1 and 2, combustion chamber wall 12, nozzle 22, cylindrical body 24, and body 26 all comprise metal, but other materials (such as ceramic bodies) suitable for a particular application may also be employed. Finally, it should be noted that, if desirable, additional combustion gas may be introduced into chamber 14 by means of additional apertures in combustion chamber wall 12 (not shown in FIG. 1).

FIG. 3 is a perspective view schematically illustrating an embodiment of the present invention which is readily adaptable to existing gaseous fuel combustors. For typical conventional gaseous fuel combustors, a multiplicity of fuel gas nozzles and combustion gas introducing means are used. The combustion gas channels are disposed in a pattern that induces a swirling flow in the combustion chamber. As shown in FIG. 3, body 34 includes 16 combustion gas channels 30, arranged so that channels 30 form two concentric circular patterns, with eight channels in each pattern. Each set of eight combustion gas channels 30 included in each circular pattern are substantially uniformly spaced around the circumference of the corresponding circle, with the direction of flow through each channel 30 having a component which is at a tangential angle to the circle. Within each channel 30, cylindrically shaped body 24 is located and disposed substantially coaxially with the longitudinal axis of channel 30, so that annularly shaped orifice 20 is defined by the outer surface of body 24 and the surface of body 34 defining channel 30. Nozzle 22 is located in the interior of cylindrical body 24 and disposed substantially coaxially with the longitudinal axis of body 24, so that annularly shaped orifice 18 is defined between the inner surface of body 24 and the outer surface of nozzle 22. Orifice 20 serves to introduce combustion gas into the combustion chamber. Nozzle 22 includes circularly shaped opening 16 which serves to introduce fuel gas into the combustion chamber. Annularly shaped orifice 18 serves to interleave cooling gas between the fuel gas and the combustion gas. Structural member 32 serves to support nozzle 22 and body 24 in position.

The foregoing describes a method for reducing nitric oxide emissions from a gaseous fuel combustor. The present invention provides a method for using a cooling gas in a gaseous fuel combustor that maximizes the concentration of cooling gas within the flame front. The instant invention also provides apparatus for reducing nitric oxide emissions that is readily adaptable to existing gaseous fuel combustors. While the apparatus has been described as having a generally circular cross section as seen in FIG. 2, it should be appreciated that other cross-sectional shapes may be employed, such as rectangular or elliptical cross sections.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. A method for reducing nitric oxide emissions from a gaseous fuel combustor, comprising:

introducing a combustion gas containing nitrogen and oxygen into a combustion chamber;

introducing a fuel gas into said chamber;

introducing a cooling gas into said chamber in such a manner that said cooling gas is interleaved between said combustion gas and said fuel gas substantially at the point where said gases are introduced into said chamber.

2. The method of claim 1 wherein said step of introducing a cooling gas into said chamber is further carried out in such a manner that the amount of said cooling gas that mixes with said combustion gas is approximately equal to the amount of said cooling gas that mixes with said fuel gas.

3. The method of claim 1 wherein said combustion gas comprises air.

4. The method of claim 1 wherein said cooling gas comprises steam.

5. The method of claim 1 wherein said fuel gas comprises methane.

6. The method of claim 2 wherein said combustion gas comprises air and said cooling gas comprises steam.

7. The method of claim 2 wherein said combustion gas comprises air, said fuel gas comprises methane, and said cooling gas comprises recirculated exhaust gas from the combustion of said combustion gas and said fuel gas.

* * * * *

UNITED STATES PATENT AND TRADEMARK OFFICE

CERTIFICATE OF CORRECTION

PATENT NO. : 4,533,314

DATED : August 6, 1985

INVENTOR(S) : Paul Vincent Heberling

It is certified that error appears in the above-identified patent and that said Letters Patent is hereby corrected as shown below:

On the first page, delete "Herberling" and substitute therefor -- Heberling --.

Signed and Sealed this

*Twenty-ninth* Day of *October 1985*

[SEAL]

*Attest:*

*Attesting Officer*

DONALD J. QUIGG

*Commissioner of Patents and Trademarks—Designate*